United States Patent [19]

Miller

[11] 4,114,554

[45] Sep. 19, 1978

[54] ANCHOR HAVING BUILT-IN TRIP DEVICE

[76] Inventor: Frank Miller, 23 King George Av., Brighton North, South Australia, Australia

[21] Appl. No.: 789,868

[22] Filed: Apr. 22, 1977

[51] Int. Cl.[2] ..... B63B 21/44

[52] U.S. Cl. ..... 114/298; 114/304

[58] Field of Search ..... 114/294, 297, 298, 301, 114/303, 304, 310, 299; 52/162, 163, 164

[56] References Cited

U.S. PATENT DOCUMENTS

| | | | |
|---|---|---|---|
| 2,007,667 | 7/1935 | Stubbs | 114/298 |
| 2,511,286 | 6/1950 | Millen | 114/298 |
| 3,463,112 | 8/1969 | Zakaitis et al. | 114/298 |

*Primary Examiner*—Trygve M. Blix
*Assistant Examiner*—Sherman D. Basinger
*Attorney, Agent, or Firm*—Jay L. Chaskin

[57] ABSTRACT

The anchor flukes are carried on a cross bar having spaced abutment plates which limit pivotal movement of a primary arm which is pivoted on the cross bar. A secondary arm also pivoted on the cross bar at one end does not have anything to limit pivotal movement and has the anchor cable secured at the other end. A pressure releasable latch interconnects the arms so that they release upon engagement of the anchor flukes with an obstruction when the boat is positioned above the anchor thereby allowing the anchor to be raised with its flukes trailing.

4 Claims, 6 Drawing Figures

ANCHOR HAVING BUILT-IN TRIP DEVICE

This invention relates to an anchor having a built-in trip device.

BACKGROUND OF THE INVENTION

Many anchors are lost because of engagement of the anchor flukes or prongs with reefs, yet such anchors can be withdrawn if the load can be applied to the flukes in a rearward direction. This is normally prevented because of the need to have an abutment plate which will limit relative movement between the anchor arm and the fluke.

The main object of this invention is to provide an anchor which will enable the anchor arm to swing over to a release position so that the flukes may be withdrawn from, for example, a reef.

BRIEF SUMMARY OF THE INVENTION

Briefly this invention has anchor flukes on a crossbar having spaced abutment plates which limit pivotal movement of a primary arm which is pivoted on the cross bar. A secondary arm is also pivoted on the cross bar at one end and has the anchor cable secured to its other end. A pressure releasable latch interconnects the arms, so that they release upon engagement of the anchor flukes with an obstruction, allowing the anchor to be raised with trailing flukes.

Relevant known prior art includes the U.S. Pat. Nos. 594,769; 2,007,667; 2,720,184; 2,959,145; 3,450,088; and 3,463,112. The closest art appears in the specification of 2,007,667, but in that specification, instead of the primary arm being interconnected with the secondary arm by a pressure releasable latch, the interconnection is by means of a gear tooth which engages in a notch.

More specifically an anchor is provided with a crossbar, abutment plates on the cross-bar, a primary arm pivoted to the cross-bar to be pivotally movable between and engageable against abutment surfaces on the abutment plates, a secondary arm also pivoted to the cross-bar at one of its ends but not engageable against said abutment plates, anchor cable attachment means at the other end of the secondary arm, pressure releasable latch means between the primary and secondary arms, and anchor flukes on the cross-bar.

The latch means can take any one of a number of forms, but in an aspect of the invention it comprises a link pivoted at one end to the swinging end of the primary arm, a withdraw pin extending through the secondary arm, the withdraw pin engaging resilient releasable means on the link which release to thereby enable the primary and secondary arm to separate from one another, but only upon the application of a considerable force. This force will exist when the primary arm abuts an abutment plate surface and the secondary arm is caused to pivot to a greater extent than the primary arm causing the two to separate from one another, as for example when an anchor fluke engages a reef.

BRIEF DESCRIPTION OF THE DRAWINGS

An embodiment of the invention is described hereunder in some detail with reference to and illustrated in the accompanying drawings in which.

DETAIL DESCRIPTION OF THE PREFERRED EMBODIMENT

Figure 1:
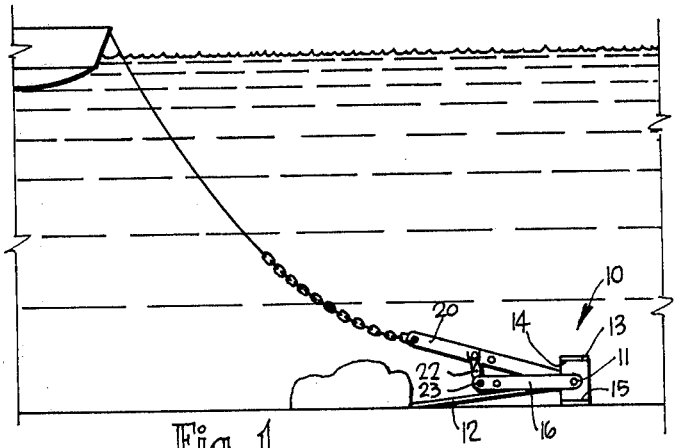
FIG. 1 is a diagrammatic representation of a boat having an anchor fluke engaging a reef.
Figure 2:
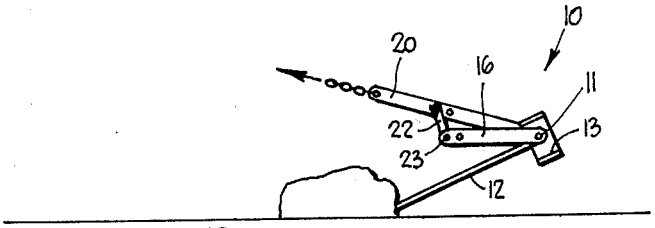
FIG. 2 is a similar diagrammatic representation showing how tensioning of the anchor cable causes the primary arm to abut an abutment surface.
Figure 3:
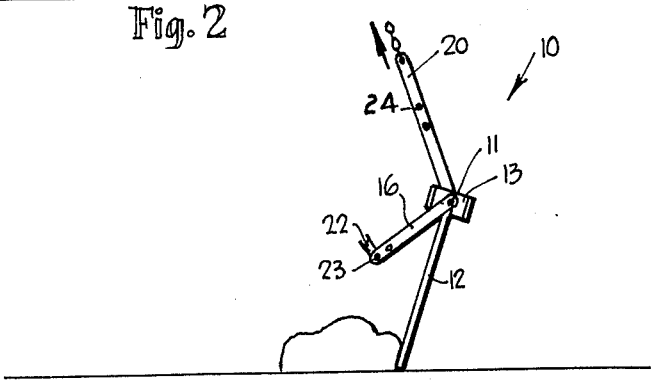
FIG. 3 is a further similar diagrammatic representation showing how latch means release results in the anchor flukes being withdrawn in a rearward direction.
Figure 6:
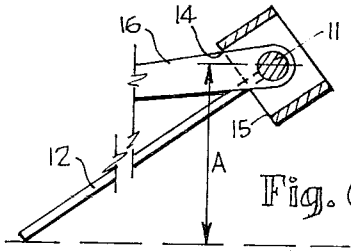
FIG. 6 is a fragmentary section similar to FIG. 5 showing engagement of the primary arm against abutment surfaces (as shown in FIG. 2).

In this embodiment an anchor 10 comprises a crossbar 11 being a circular section bar which is provided with two anchor flukes 12 welded one near each end, but the central portion of the bar is free of anchor flukes. There is welded to the central portion of the bar an abutment plate 13 of rectangular tubular cross-section, the abutment plate 13 having two surfaces 14 and 15 which function as abutment surfaces upon pivoting of a primary arm 16 about the crossbar 11 beyond a certain limit which is determined with reference to the angle usually occupied by the anchor rope when the anchor is in use (FIGS. 1 and 2). In this embodiment the primary arm 16 is a single bar, and the abutment plate 13 is welded to the cross-bar 11 of the anchor. A secondary arm 20 is formed from two bars one each side of the abutment plate 13, the secondary arm being freely pivotal about the cross bar 11, and being positioned between the two flukes 12. The secondary arm 20 has an anchor cable attachment aperture 21 at its swinging end. Between the primary arm and the secondary arm is provided a link 22, the link 22 being pivotal on a primary arm pivot pin 23, and engaging a withdraw pin 24 which extends between the two portions of the secondary arm 20. The withdraw pin 24 passes through a 'U' shaped slot formed by the ends of the link 22, and constitutes a pressure release latch between the primary and secondary arms which is releasable only on the application of considerable force, because of the resilience of the link ends and the relatively short moment arm designated 'A' in FIG. 6. Resilience is afforded by the bifurcate end of the link the arms of which must be spread considerably to release the pin 24.

Figure 4:
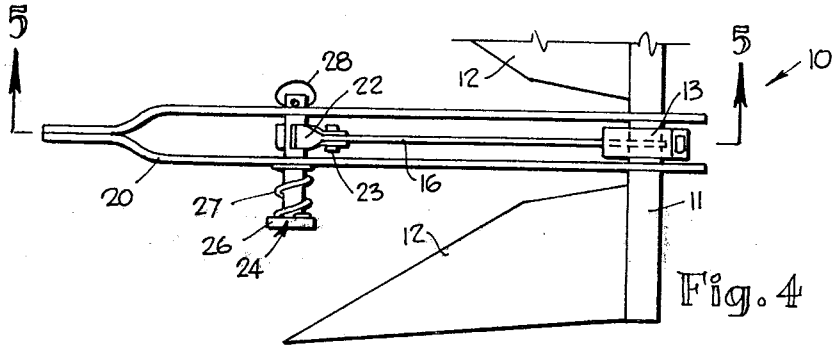
FIG. 4 is a fragmentary plan view of the anchor drawn to an enlarged scale.
Figure 5:
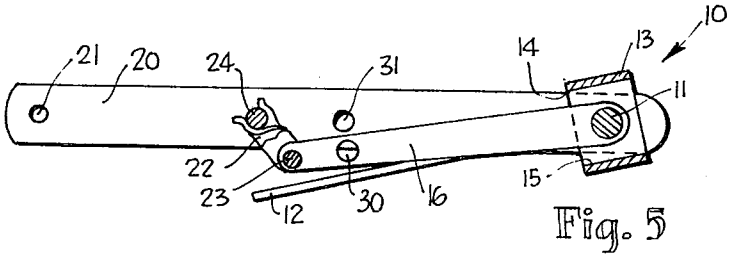
FIG. 5 is a section taken on line 5—5 of FIG. 4.

The withdraw pin 24 is a pin having a head 26 at one end and a compression spring 27 between the head and the secondary arm 20, while the other end is provided with a lever latch 28 (FIG. 4). The arrangement is such that the compression spring 27 draws the lever latch 28 into firm engagement with the other side of the secondary arm 20, and the lever latch can only be released by firstly compressing the spring 27 and subsequently rotating the lever latch 28 in the pin 24.

The primary and secondary arms also have apertures designated 30 and 31 which are aligned when the arms are aligned, and the apertures are of such dimension that the withdraw pin 24 can be interposed between the two arms to ensure that there is a firm locking of the two arms, this being necessary for example if the anchor is required to moor a boat in one position for a considerable period of time and there is little or no danger of the flukes getting engaged in rocks or reefs.

A brief consideration of the abovementioned embodiment will indicate that the invention is simple. It will be seen that under normal usage the flat angle of the anchor cable (rope or chain) will be such that no force is imposed on the pressure releasable latch. Force is imposed on the latch only when a boat is nearly vertically above the anchor so that the anchor rope or chain is more nearly vertical, this being a condition encountered when it is desired to release the anchor.

Various modifications and improvements may be made by one skilled in the art to the apparatus disclosed herein without departing from the scope of the invention as defined by the claims.

I claim:

1. An anchor having a cross-bar, abutment plates on the cross-bar having abutment surfaces, a primary arm, pivot means pivoting the primary arm for pivotal movement with respect to the cross-bar to be movable between and engageable against said abutment surfaces, a secondary arm, pivot means also pivoting the secondary arm at one of its ends for pivotal movement with respect to the cross-bar, said secondary arm not being engageable against said abutment plates, anchor cable attachment means at the other end of the secondary arm, anchor flukes on the cross-bar, and pressure releasable latch means between the primary and secondary arms, said latch means comprising:

a link, a pivot pin joining one end of the link to the swinging end of the primary arm, the other end of the link being bifurcate and comprising a pair of spaced resilient arms, and a pin in the secondary arm engaged by the resilient arms of the link but releasable therefrom on the application of force separating the primary and secondary arms.

2. An anchor according to claim 1 wherein said pin engageable by the link arms is a withdraw pin which extends between two portions of the secondary arm.

3. An anchor according to claim 1 wherein the primary and secondary arms have apertures extending therethrough which can be aligned and maintained in alignment by insertion of said pin.

4. An anchor according to claim 1 wherein the abutment plates are opposite walls of a rectangular section tube which is secured to the cross-bar by the process of welding.

* * * * *